US009155352B2

(12) United States Patent
Seo

(10) Patent No.: US 9,155,352 B2
(45) Date of Patent: Oct. 13, 2015

(54) PROPULSIVE SOLE FOR IMPACT DISTRIBUTION AND ROUND WALKING

(75) Inventor: Woo Seung Seo, Seoul (KR)

(73) Assignee: JIONE FRS CORPORATION, Seoul (KR)

( * ) Notice: Subject to any disclaimer, the term of this patent is extended or adjusted under 35 U.S.C. 154(b) by 254 days.

(21) Appl. No.: 13/695,537

(22) PCT Filed: Dec. 5, 2011

(86) PCT No.: PCT/KR2011/009352

§ 371 (c)(1),
(2), (4) Date: Jan. 11, 2013

(87) PCT Pub. No.: WO2012/077945

PCT Pub. Date: Jun. 14, 2014

(65) Prior Publication Data

US 2013/0145650 A1 Jun. 13, 2013

(30) Foreign Application Priority Data

Dec. 7, 2010 (KR) ..... 10-2010-0124566

(51) Int. Cl.
*A43B 13/14* (2006.01)
*A43B 13/18* (2006.01)
*A43B 3/00* (2006.01)
(Continued)

(52) U.S. Cl.
CPC ..... *A43B 13/181* (2013.01); *A43B 3/0036* (2013.01); *A43B 13/04* (2013.01); *A43B 13/125* (2013.01); *A43B 13/14* (2013.01); *A43B 13/141* (2013.01)

(58) Field of Classification Search
CPC .. A43B 3/0036; A43B 3/0063; A43B 3/0068; A43B 13/14
USPC ..... 36/25 R, 114, 28, 59 C; D2/947, 953
See application file for complete search history.

(56) References Cited

U.S. PATENT DOCUMENTS 4,130,947 A 12/1978 Denu
D395,540 S 6/1998 Gaudio
(Continued)

FOREIGN PATENT DOCUMENTS

JP 10-248606 A 9/1998
KR 2019900001760 3/1990

OTHER PUBLICATIONS

PCT/KR2011/009352 International Search Report mailed Jun. 22, 2012.
(Continued)

*Primary Examiner* — Marie Bays
(74) *Attorney, Agent, or Firm* — Kunzler Law Group

(57) ABSTRACT

A shoe sole 3 of the present invention comprises a midsole 4 and an outsole 5, in which the outsole 5 includes a cushion member 10 formed beneath the midsole 4, in a shape of a series of zigzags, with a determined thickness and width. The cushion member may disperse the wearer's weight uniformly to the whole area of the shoe sole and may provide comfortable deformation of the shoe sole according to the wearer's walking behavior due to spaces defined in the cushion member. Since the cushion member gets opened and shrunk repeatedly while walking, the wearer can propel one's round walking, thereby that the shoe sole can reduce the fatigue of the wearer's feet and protect the wearer's joints like ankles and knees safely.

10 Claims, 5 Drawing Sheets

(51) Int. Cl.
*A43B 13/04* (2006.01)
*A43B 13/12* (2006.01)

(56) References Cited

U.S. PATENT DOCUMENTS

D516,781 S * 3/2006 Ardissono et al. ..... D2/954
D712,643 S * 9/2014 Seo ..... D2/953
D716,535 S * 11/2014 Seo ..... D2/953
2003/0097767 A1 5/2003 Perkinson
2004/0194343 A1* 10/2004 Kim ..... 36/29
2011/0016746 A1* 1/2011 Callahan et al. ..... 36/28
2011/0016749 A1* 1/2011 Callahan et al. ..... 36/103
2011/0232130 A1* 9/2011 Boudreau et al. ..... 36/88
2012/0011747 A1* 1/2012 Borel et al. ..... 36/25 R
2012/0167416 A1* 7/2012 Christensen et al. ..... 36/103

OTHER PUBLICATIONS

PCT/KR2011/009352 Written Opinion of the International Searching Authority mailed Jun. 22, 2012.

* cited by examiner (a)

(b)

PROPULSIVE SOLE FOR IMPACT DISTRIBUTION AND ROUND WALKING

TECHNICAL FIELD

The present invention relates to a shoe sole, more particularly relates to a shoe sole with propelling function for impact dispersion and round walking, in which a cushion member having determined thickness and width is provided in a shape of a series of zigzags, from a heel to a toe at regular intervals, and a non-slip pad is attached on the bottom of and along the cushion member. The cushion member disperses a wearer's weight uniformly on the whole of the shoe sole, the intervals of the cushion member provides the deformation of the shoe sole while walking, such that the shoe sole can propel a round walking in opening and closing processes of the cushion member.

BACKGROUND OF THE ART

In general, shoes are used to protect a human's feet, and may be manufactured and be sold in a various shapes and kinds. A Shoe includes an upper for protecting an instep and an ankle, and a shoe sole for protecting a sole of the foot, in which the shoe sole increases the friction for walking and softening the impact from the sole while walking.

To soften the impact transferred from the ground to the sole in the above general shoe, an insert can be inserted inside the shoe, the shoe sole or the heel can be made of high buffering rubber and form sponge, or the shoe sole can include a built-in elastic part like an airbag or a spring.

As above mentioned, in case that a shoe sole is made only of rubber or form sponge or has an elastic member like an airbag or a spring inside, it can just absorb impact but cannot help a natural and effective walking. When walking along a walking path which is approximately shaped of an arc traveling from the heel to the toe, the conventional shoe soles have a problem that they cannot help the walker walk naturally and effectively.

Specially, since many people enjoy a bountiful life and work in 5 days per a week, the population of people who enjoy an outdoor life is steeply increasing. At the same time, many shoe makers are investing much time and effort to develop functional shoes, which can provide an improved wearing sensation, protect one's knee and ankle, and improve one's health only in case of walking with the shoes.

As various functions applicable to the outdoor shoes, there are shoes which are for non-slip, impact absorption, air ventilation, preventing athlete's foot, and odor treatment, and are also for round walking which propels one's walking naturally and effectively, as if a sphere rolls on a plane.

Relating to shoe which help the round walking and a walking propelling member therefor, a Korean Patent No. 10-560367 filed on Dec. 9, 2005 and registered on Mar. 7, 2006, discloses a walking propelling member and shoes having the walking propelling member built-in.

The conventional walking propelling member as above mentioned, includes an upper body and a lower body both shaped of a shoe heel, in which a wall member is formed between the upper and lower bodies. The wall member has a central wall vertically standing at the point of about ⅗~⅘ of the upper/lower bodies, and a first and a second pressing walls a tilt inclined, which are getting more and more inclined from the central wall to both side ends until 16~20 degrees.

Therefore, when a determined pressure is applied through the conventional walking propelling member, the pressure ratio is high at one end of the walking propelling member, is getting lower as moving to a center of the waling propelling member and getting higher as moving from the center to the other end, wherein the walking propelling member gets curved in a shape of an arc.

In a case that the above conventional walking propelling member is built in the heel portion of the shoe sole or installed as a shoe heel, it can be pressed into a curved shape for round walking by loads of a body applied successively, so as to absorb walking impact, protect the joints of the knee and the ankle, and reduce fatigue on the sole, through natural and effective walking.

But, since the conventional walking propelling member is positioned at the heel of the shoe sole, a short round walking is performed at the first time when the heel touches the ground, however no further round walking follows during the period of walking from the medial arch of foot to the toe.

Accordingly, there are problems that the conventional shoe sole cannot protect the walker's knee and ankle and reduce fatigue of the foot sole, with failure to more reasonable and effective load dispersion and round walking over the whole of the foot sole. Although some of the conventional shoe soles may have an additional built-in walking propelling member, such as airbag or spring, the costs for manufacturing the shoe may increase due to the inconvenience of shoe producing.

TECHNICAL OBJECT

The present invention provides a shoe sole with propelling function for impact dispersion and round walking, in which a cushion member is formed in a shape of a series of zigzags, with a determined thickness and width, and a non-slip pad is attached on the whole or part of bottom of the cushion member, such that the cushion member can disperse a wearer's weight uniformly on the whole of the shoe sole and be deformed suitably according to the wearer's walking.

The present invention provides a shoe sole for natural and effective round walking, in which the thickness of the front part of the cushion member increases gradually from a medial arch to a heel, the thickness of the rear part increases and then decreases gradually from the medial arch to a toe, and the width of the toe and heel portions of the cushion member is larger than that of the middle portion thereof. The shoe sole of the present invention can perform an active and successive propelling walking from an initial step at the heel to an end pushing at the toe. The shoe sole of the present invention can provide an improved wearing sensation, protect one's knee and ankle, and improve one's health only in case of walking with the shoes.

SUMMARY OF THE INVENTION

According to one exemplary embodiment of the present invention, a shoe sole may comprises a midsole and an outsole, wherein the outsole includes a cushion member formed beneath the midsole, in a shape of a series of zigzags, with a determined thickness and width. The cushion member can disperse a wearer's weight uniformly on the whole of the shoe sole and be deformed suitably according to the wearer's walking. Therefore, the shoe sole of the present invention can reduce fatigue on the sole of foot and protect the joints of the knee and the ankle, through natural and effective walking.

The shoe sole of the present invention may be formed using compressed sponge, injection pylon or other synthetic resin, occasionally may be formed using high elastic supporting material, to be attached to an upper of the shoe or to another shoe sole.

The cushion member may be formed on the whole area of the sole from the heel to the toe, while it may be formed on the partial area, for example on the heel portion, the toe portion or the heel/toe portions respectively.

As mentioned below, the cushion member may be formed to have different thicknesses and widths at various parts of the sole.

For example, the cushion member may provide spaces, each of which is defined inside zigzag curved sections to have one lateral opening, thereby to disperse impact effectively. In this instance, the zigzag curved sections bending at both lateral sides in the cushion member may be formed to be relatively thicker and wider than a central section.

The space defined inside the zigzag curved section may have an opening which is narrower than inside of the space, so that the shoe sole may be light weight and have a buffering function like air cushion.

The thickness of the front part of the cushion member may increase gradually from a medial arch to a heel, the thickness of the rear part may increase and then decrease gradually from the medial arch to a toe, such that the cushion member can absorb an initial shock at the heel and disperse the wearer's weight to the front/rear parts at standing position, because the middle part is relatively thinner than the front/rear parts. Moreover, the cushion member which has the relatively thin middle part can be easily deformed at the middle part. When propelling by pushing the ground at the toe, the front part of the cushion member which is relatively thicker than the middle part can generate increased restoring force to propel the walking.

EFFECT OF THE INVENTION

The shoe sole of the present invention which have the zigzag curved cushion member, can disperse the wearer's weight uniformly on the whole area of the sole and be deformed suitably according to the wearer's walking. The shoe sole of the present invention can help a propelling walking, because the cushion member is repeatedly opened and closed. The shoe sole of the present invention may be manufactured in light weight and in low costs rather than the conventional shoe sole with any additional built-in propelling means.

In the shoe sole of the present invention, the thickness of the front part of the cushion member may increase gradually from a medial arch to a heel, the thickness of the rear part may increase and then decrease gradually from the medial arch to a toe, and the widths of the toe and heel portions of the cushion member may be larger than that of the middle portion thereof, such that the shoe sole of the present invention can perform an active and successive propelling walking from an initial step at the heel to an end step at the toe. The shoe sole of the present invention can provide an improved wearing sensation, protect one's knee and ankle, and improve one's health only in case of walking with the shoes.

DETAIL DESCRIPTION OF EMBODIMENTS

Figure 1:
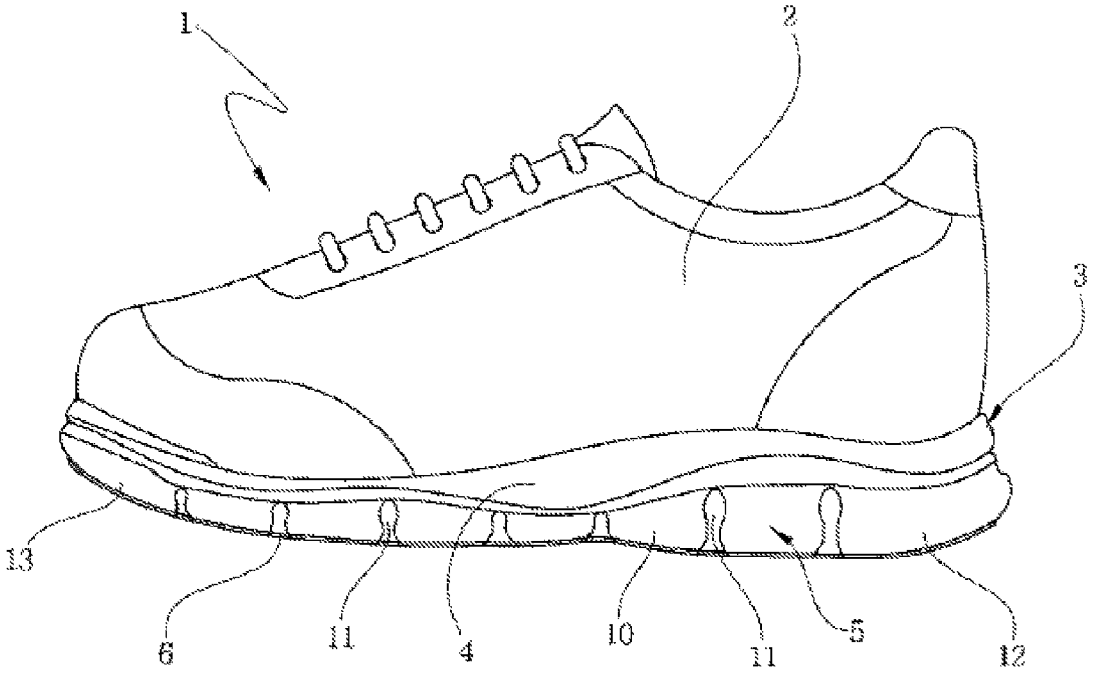
FIG. 1 is a side view illustrating a shoe including a shoe sole according to the present invention.

Reference will now be made in detail to the preferred embodiments of the present invention, examples of which are illustrated in the accompanying drawings. It is to be understood that the present invention is not limited by the embodiment only. Wherever possible, the same reference numbers will be used throughout the drawings to refer to the same or like parts. Under this rule, reference may be made referring to examples illustrated in other drawings, and description apparent to those skilled in the art or repeated parts will be omitted.

A shoe sole 3 may be provided below a shoe upper 2 as a part of a shoe 1, which comprises a midsole 4, an outsole 5, and a non-slip pad 6. The shoe sole 3 has the outsole 5 for improving propelling walking and impact dispersion.

The outsole 5 of the shoe sole 3 according to the present invention, as depicted in FIGS. 1 to 5, includes a cushion member 10 formed beneath the midsole 4, in a shape of a series of zigzags, with a determined thickness and width. The non-slip pad 6 is attached on the bottom of the cushion member 10.

Figure 2:
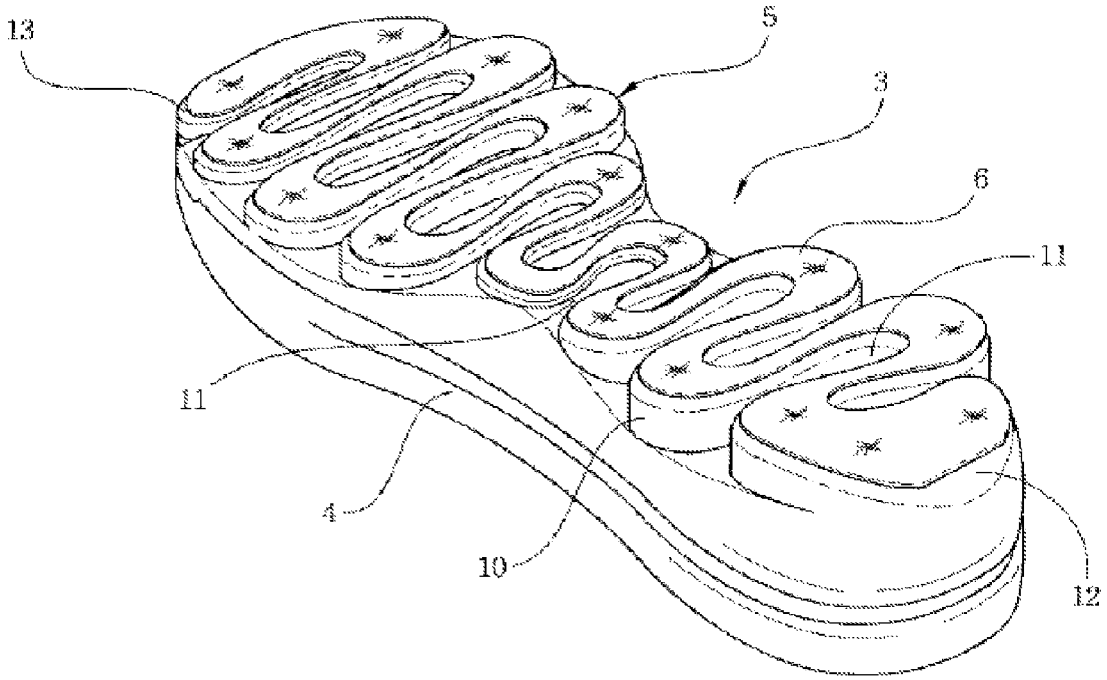
FIG. 2 is a bottom perspective view illustrating the shoe of FIG. 1.
Figure 3:
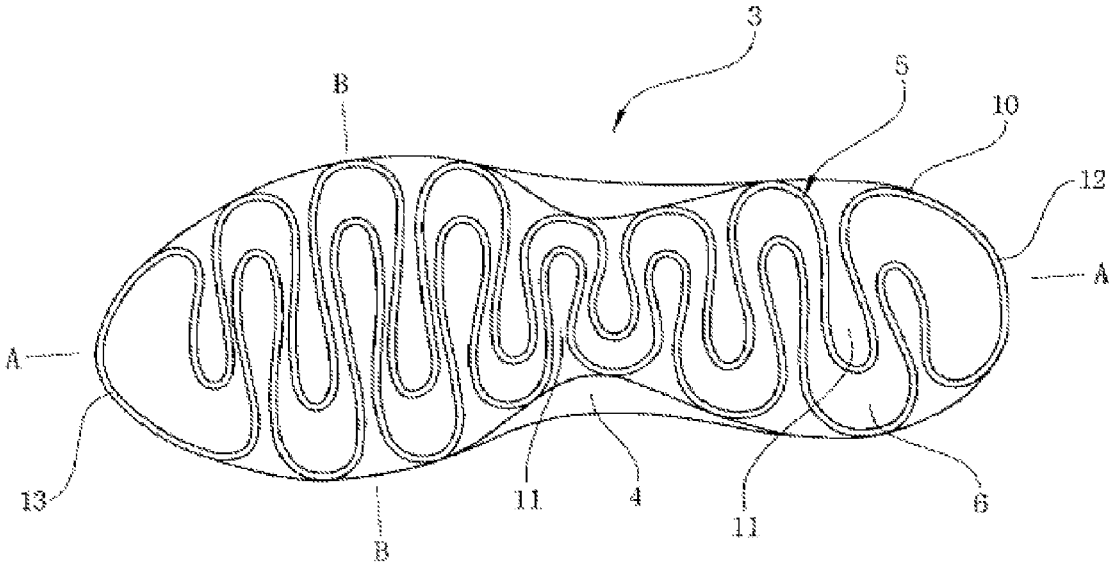
FIG. 3 is a bottom view illustrating the shoe sole according to the present invention.

The cushion member 10 is shaped of zigzags, moreover, as depicted in FIGS. 2 and 3, the cushion member 10 provides spaces 11 defined inside zigzag curved sections to have one lateral opening, thereby to disperse impact effectively.

Figure 5:
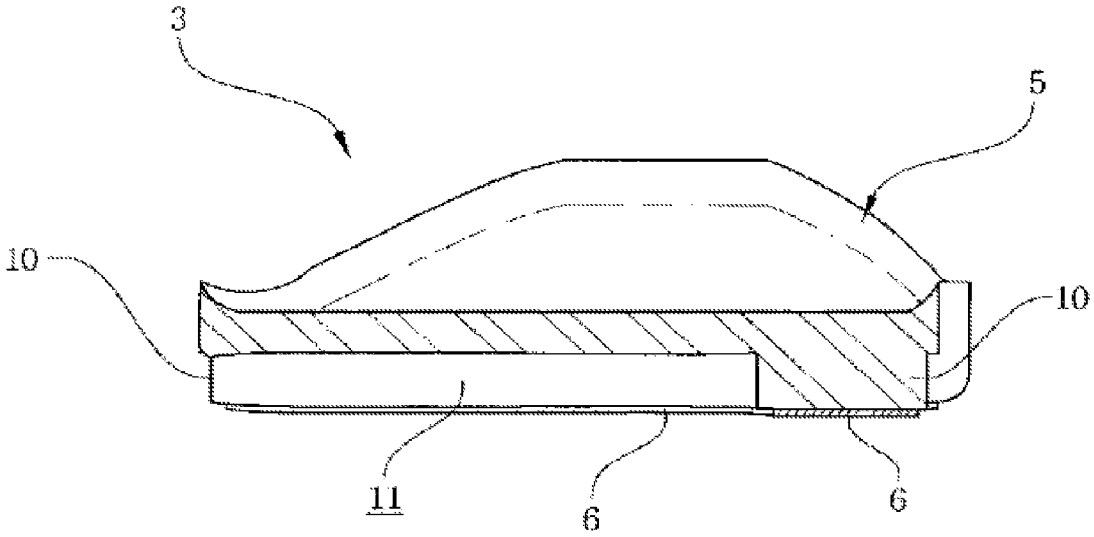
FIG. 5 is a sectional view of B-B in FIG. 3, FIG. 6 are side views illustrating walking processes according to the present invention, and FIG. 7 are sectional views illustrating other embodiments of shoe soles according to the present invention.

As shown in FIG. 5, the space 11 defined inside the cushion member 10 has one side opened (as seen at left in FIG. 5) and the other side closed by the zigzag curved section (as seen at right in FIG. 5), such that openings of the spaces 11 are alternately formed to see opposite directions reciprocally.

According to the shape of the cushion member 10 and the spaces between the cushion member 10, the cushion member 10 can disperse a wearer's weight uniformly on the whole of the shoe sole 3 and be deformed suitably according to the wearer's walking. Therefore, the shoe sole 3 can perform a propelling walking because the cushion member 10 is repeatedly opened and closed.

On the other hand, since the space 11 defined in the cushion member 10 includes the one side opened and the other side closed in the zigzag curved sections, the spaces 11 can be opened by a determined width and then be restored quickly into the original status.

Comparing the conventional shoe sole which has transverse grooves formed on its bottom, the cushion member 10 of the present embodiment can provide an improved propelling force by repeatedly griping and pushing the ground. In this instance, the non-slip pad 6 attached on the bottom of the cushion member 10 can improve the propelling force much more.

The cushion member 10 may compose the shoe sole 5 by itself, otherwise may form a lower part of the shoe sole 5 with the outsole 5 attached on the its bottom. The shoe sole 5 including the cushion member 10 may be formed using hard rubber or polyurethane form, otherwise using various materials available to the shoe sole.

Figure 4:
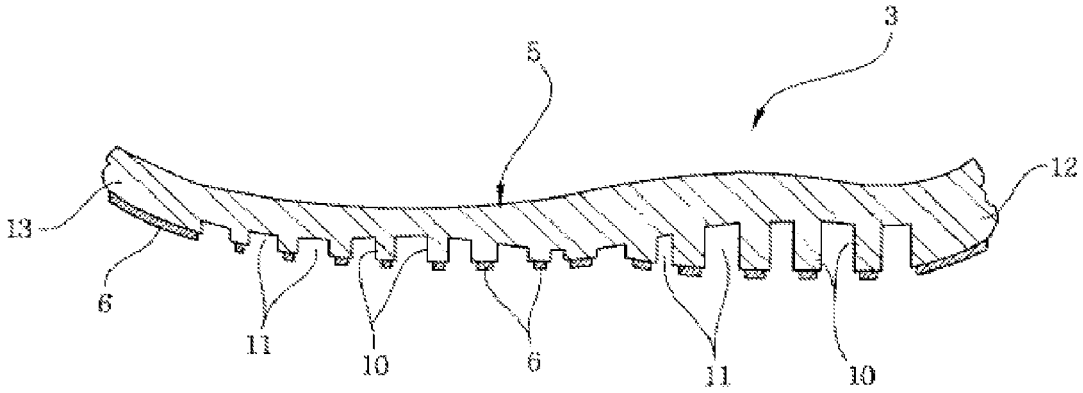
FIG. 4 is a sectional view of A-A in FIG. 3.

Referring to FIGS. 1 and 4, the thickness of the cushion member 10 increases gradually from a medial arch, which is a partially sunk portion in the sole of the foot, to a heel, and the thickness of the cushion member 10 increases and then decreases gradually from the medial arch to a toe. Namely, the thickness of the grooves forming the spaces 11 based on the bottom surface of the shoe sole 3 increases gradually.

Figure 6:
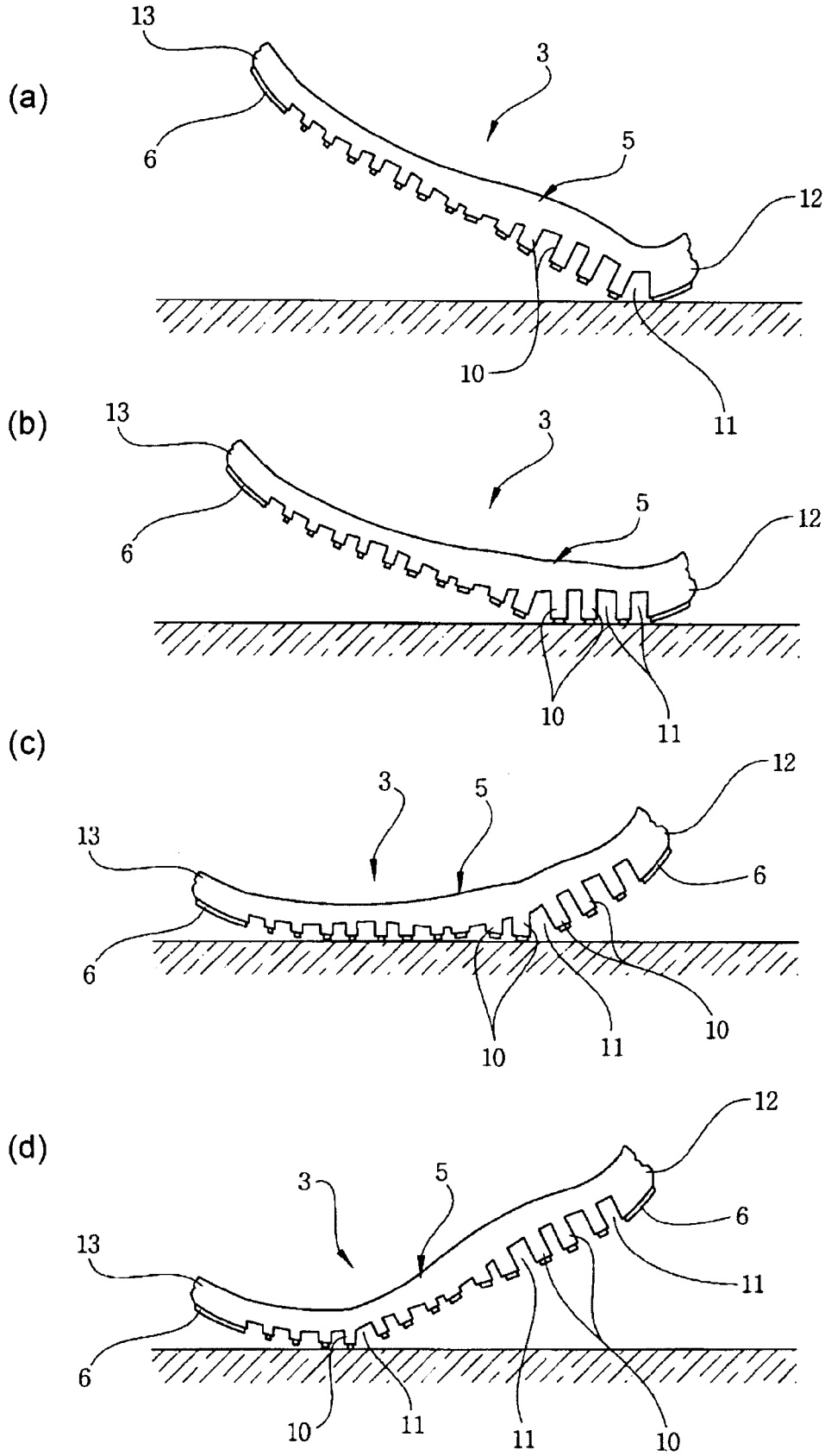

In case of improving the structure of the outsole 5 as above mentioned, the cushion member 10 bends upwardly at an initial time when the heel portion of the outsole 5 touches the ground as shown in (A) of FIG. 6. Then, the cushion member 10 is deformed comparatively small at a middle time as shown in (B) and (C) of FIG. 6. At last, the cushion member 10 bends upwardly again at the last time of walking.

The deformations of the shoe sole 3 at the initial and the last time are relatively noticeable rather than those at the middle time of walking, such that the walking person can perform a propelling round walking.

To maintain the propelling round walking up to the toe portion of the shoe sole 3, the front end portion of the outsole 5 may be formed inclined upward in an arc, which can be applied to the conventional shoe sole.

Referring to FIGS. 2 to 4, the heel portion 12 and the toe portion 13 of the cushion member 10 are formed to have a width wider than the middle portion of the cushion member 10.

Accordingly, the cushion member 10 can provide a wide and stable contact area at the initial time and the last time, at that time the cushion member 10 is most noticeably deformed, so the walking person can experience fatigue little and protect his joints like ankles and knees safely.

Figure 7:
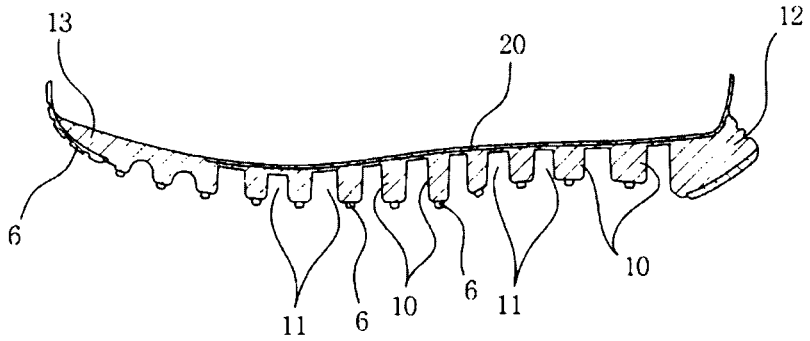
Figure 7:
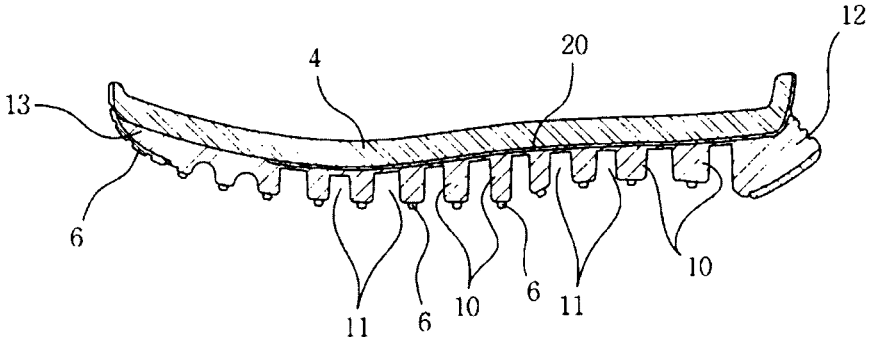

(A) of FIG. 7 is a sectional view illustrating another embodiment of a shoe sole according to the present invention. In (A) of FIG. 7, a cushion member 10 is independently formed in a shape of zigzag, and a supporting member 20 is installed on the cushion member 10 to maintain stability when walking.

The shoe sole 3 of the present invention may be deformed excessively in the processes depicted in FIG. 6, however, as shown in (A) of FIG. 7, the supporting member 20 with a curved section is mounted on the top of the cushion member 10, so as to wrap and support the circumference of the foot stably.

(B) of FIG. 7 is a sectional view illustrating still another embodiment of a shoe sole according to the present invention. Referring to (B) of FIG. 7, a midsole 4 is mounted on the supporting member 20 as described in (A) of FIG. 7, such that the shoe sole can provide a maximized buffering effect due to the supporting member 20 and the midsole 4, and make it possible to perform a propelling round walking due to the supporting member 20 and the cushion member 10.

The invention claimed is:

1. A shoe sole with propelling function for impact dispersion and round walking, the shoe sole comprising:

a midsole;

and an outsole, wherein the outsole includes a cushion member formed on a bottom of the midsole, wherein the cushion member extends in a continuous zigzag shape along the bottom of the midsole with peaks of the zigzag shape transitioning into troughs of the zigzag shape in a lateral direction across a width of the midsole.

2. The shoe sole of claim 1, wherein the cushion member provides a space defined inside a zigzag curved section to have one lateral opening, thereby to disperse impact.

3. The shoe sole of claim 2, wherein zigzag curved sections at both lateral sides in the outsole are relatively thicker and wider than a middle section in the outsole.

4. The shoe sole of claim 2, wherein the opening of the space is narrower than inside of the space.

5. The shoe sole of claim 1, wherein the thickness of the cushion member increases gradually from a medial portion to a heel portion, and the thickness of the cushion member increases and then decreases gradually from the medial arch portion to a toe portion.

6. The shoe sole of claim 1, wherein toe and heel portions of the cushion member are formed wider than a middle portion thereof.

7. The shoe sole of claim 1, wherein the zigzag shaped cushion member is provided independently with a support member which is formed on the cushion member in a shape of a sole of the foot.

8. The shoe sole of claim 7, wherein the midsole is provided on the cushion member.

9. The shoe sole of claim 1, further comprising a non-slip pad attached on the whole or part of bottom of the cushion member.

10. The shoe sole of claim 1, wherein the cushion member is shaped in a series of zigzags from the heel portion to the toe portion.

* * * * *